US005400538A

United States Patent [19]

Shannon

[11] Patent Number: 5,400,538

[45] Date of Patent: Mar. 28, 1995

[54] FIREARM TRIGGER LOCK

[76] Inventor: Bradley N. Shannon, R.R. 1 Box 681, Eufaula, Okla. 74432-9801

[21] Appl. No.: 183,882

[22] Filed: Jan. 21, 1994

[51] Int. Cl.[6] ..... F41A 17/54; F41A 17/04

[52] U.S. Cl. ..... 42/70.07; 42/70.06; 42/70.11

[58] Field of Search ..... 42/70.06, 70.07, 70.01, 42/70.11

[56] References Cited

U.S. PATENT DOCUMENTS

| | | | |
|---|---|---|---|
| 3,956,842 | 5/1976 | Ballenger | 42/70.07 |
| 4,014,123 | 3/1977 | Williams | 42/70.11 |
| 4,199,026 | 4/1980 | Capolupo | 42/70.11 |
| 4,499,681 | 2/1985 | Bako et al. | 42/70.07 |

*Primary Examiner*—Stephen M. Johnson
*Attorney, Agent, or Firm*—Hugh E. Smith

[57] ABSTRACT

A trigger lock for firearms wherein a pair of discs loosely connected together by a flexible band are adapted to be positioned one on each side of the trigger guard of a firearm. When pushed towards each other, a pair of tapered spring detent arms fixed to the internal face of the first of said discs engage in a pair of apertures in the second of said discs from which they may be disengaged by finger pressure. A central hocking pin positioned centrally on the second of said discs engages with a central tumblered locking receptacle positioned centrally on the internal face of the first of said discs and locks into place therein. The external face of the first of said discs carries a circularly arranged set of numbers, e.g. 1 through 8, and a knob mounted on the outer end of the central locking receptacle. The knob carries an indicating pointer and when rotated to a preset two-numbered combination causes the tumblers within such central locking receptacle to disengage from the locking grooves on the locking pin freeing such pin to be withdrawn when the tapered detent arms are also disengaged, thus allowing removal of the trigger lock assembly from the firearm.

2 Claims, 4 Drawing Sheets

FIG 1
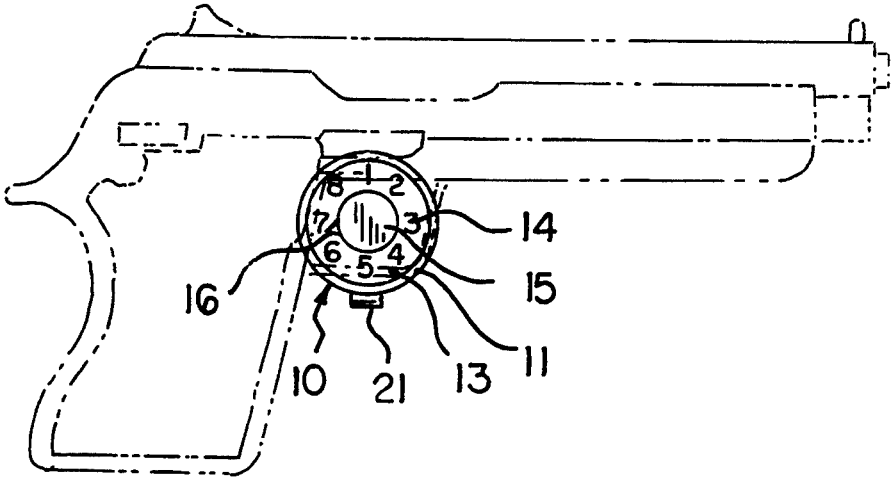
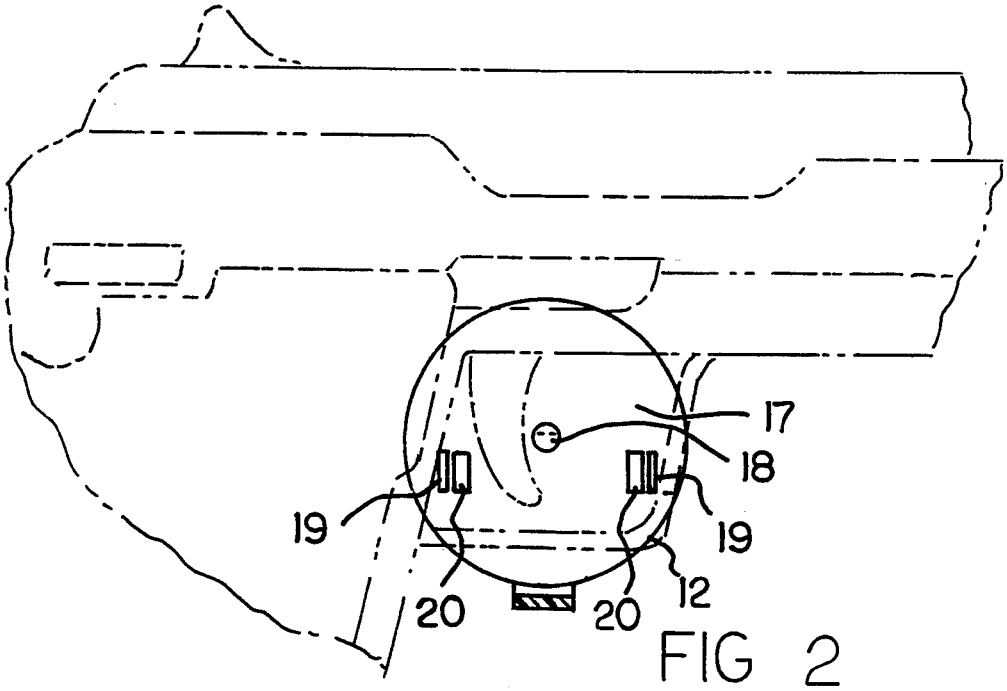
FIG 2

FIG 3
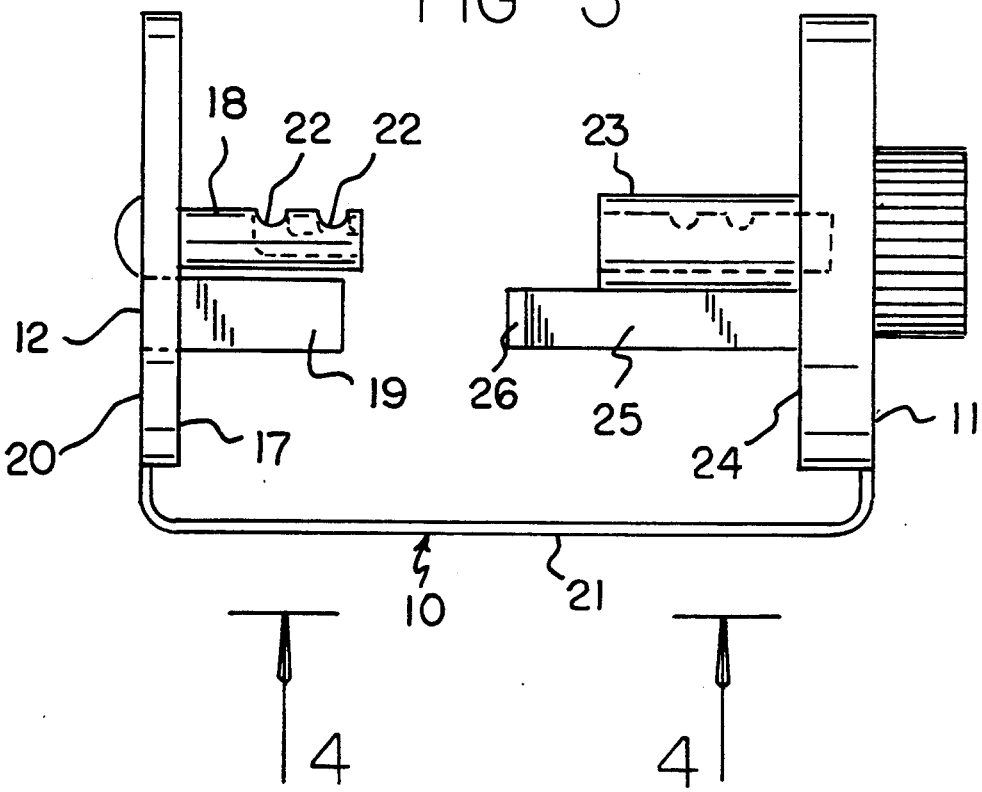
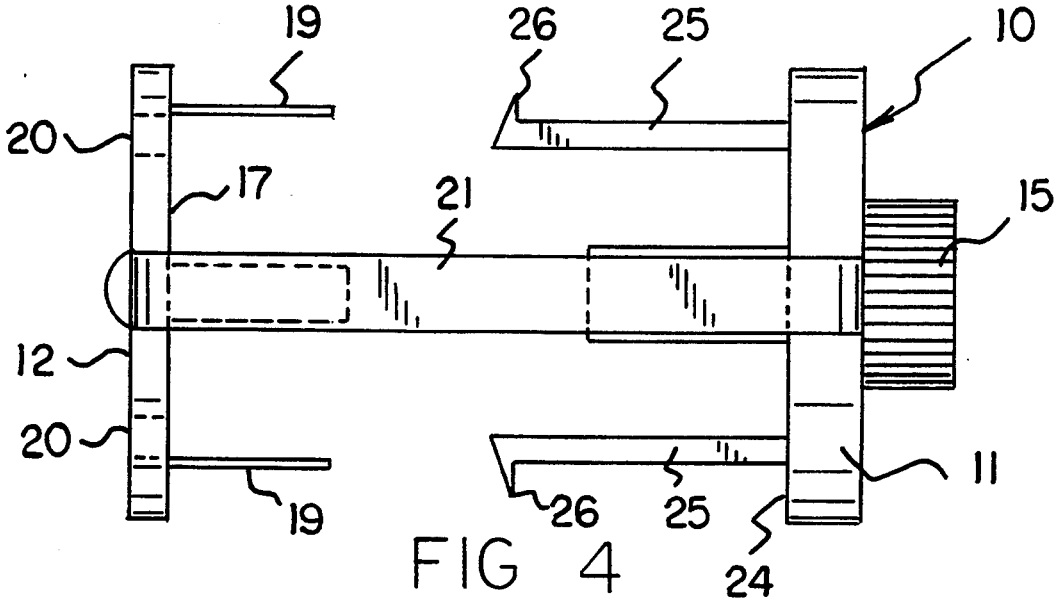
FIG 4

FIREARM TRIGGER LOCK

BACKGROUND OF THE INVENTION

1. Field of the Invention

The present invention relates to firearm trigger guards and more particularly pertains to such a trigger guard which unlocks by use of a combination.

2. Description of the Prior Art

The use of firearm trigger guards is known in the prior art. More specifically, such guards heretofore devised and utilized for the purpose of locking the triggers of firearms are known to consist basically of familiar, expected and obvious structural configurations, notwithstanding the myriad of designs encompassed by the crowded prior art which have been developed for the fulfillment of countless objectives and requirements. These devices utilize a plurality of different types of wrenches, keys or the like to prevent unauthorized or accidental opening of the guard. For example, U.S. Pat. No. 3,616,559 requires a special key wrench 18. U.S. Pat. No. 4,509,281 utilizes an unusually shaped socket 42 requiring a separate tool or key. U.S. Pat. No. 3,956,842 requires a specialized wrench to open the guard. U.S. Pat. No. 3,964,200 uses a padlock on the guard. U.S. Pat. No. 5,050,328 does not employ a child-proof lock but is disengaged by manually spreading a pair of pins 20. Losing or misplacing the special key or wrench is a distinct possibility. In an emergency, e.g. for use of the firearm against an intruder, such delays could be disastrous.

In this respect, the trigger guard lock according to the present invention substantially departs from the conventional concepts and designs of the prior art, and in so doing provides an apparatus primarily developed for the purpose of easy disengagement of the locked guard from the firearm while preventing any unauthorized disengagement.

Therefore, it can be appreciated that there exists a continuing need for new and improved safety trigger guard which can be easily disengaged. In this regard, the present invention substantially fulfills this need.

SUMMARY OF THE INVENTION

In view of the foregoing disadvantages inherent in the known types of firearm trigger guards now present in the prior art, the present invention provides an improved trigger guard construction wherein the same can be utilized safely yet be easily disengaged. As such, the general purpose of the present invention, which will be described subsequently in greater detail, is to provide a new apparatus which has many of the advantages of the trigger guards mentioned heretofore and many novel features that result in a firearm trigger guard which is not anticipated, rendered obvious, suggested, or even implied by any of the prior art devices, either alone or in any combination thereof.

To attain this, the present invention generally comprises a trigger lock for firearms wherein a pair of discs loosely connected together by a flexible band are adapted to be positioned one on each side of the trigger guard of a firearm. When pushed towards each other, a pair of tapered spring detent arms fixed to the internal face of the first of said discs engage in a pair of apertures in the second of said discs from which they may be disengaged by finger pressure. A central locking pin positioned centrally on the second of said discs engages with a central tumblered locking receptacle positioned centrally on the internal face of the first of said discs and locks into place therein. The external face of the first of said discs carries a circularly arranged set of numbers, e.g. 1 through 8, and a knob mounted on the outer end of the central locking receptacle. The knob carries an indicating pointer and when rotated to a preset two-numbered combination causes the tumblers within such central locking receptacle to disengage from the locking grooves on the locking pin freeing such pin to be withdrawn when the tapered detent arms are also disengaged, thus allowing removal of the trigger lock assembly from the firearm.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trigger guard apparatus which has many of the advantages of the devices mentioned heretofore and many novel features that result in a firearm trigger guard which is not anticipated, rendered obvious, suggested, or even implied by any of the prior art devices, either alone or in any combination thereof.

It is another object of the present invention to provide a new and improved firearm trigger guard which may be easily and efficiently manufactured and marketed.

It is a further object of the present invention to provide a new and improved firearm trigger guard which is of a durable and reliable construction.

An even further object of the present invention is to provide a new and improved firearm trigger guard which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved firearm trigger guard which provides in the apparatuses of the prior art some of the advantages thereof, while simultaneously overcoming some of the disadvantages normally associated therewith.

Still another object of the present invention is to provide a new and improved firearm trigger guard secured by a combination lock.

Yet another object of the present invention is to provide a new and improved firearm trigger guard which eliminates the problem of special locking tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side plan view of the device of the present invention in place on a firearm.

FIG. 2 is a similar view with one of the discs removed in order to show the interior of the other disc.

FIG. 3 is a side plan view of the device of the present invention in its unlocked configuration.

FIG. 4 is a bottom plan view on line 4—4 of FIG. 3.

DESCRIPTION OF THE PREFERRED EMBODIMENT

Figure 5:
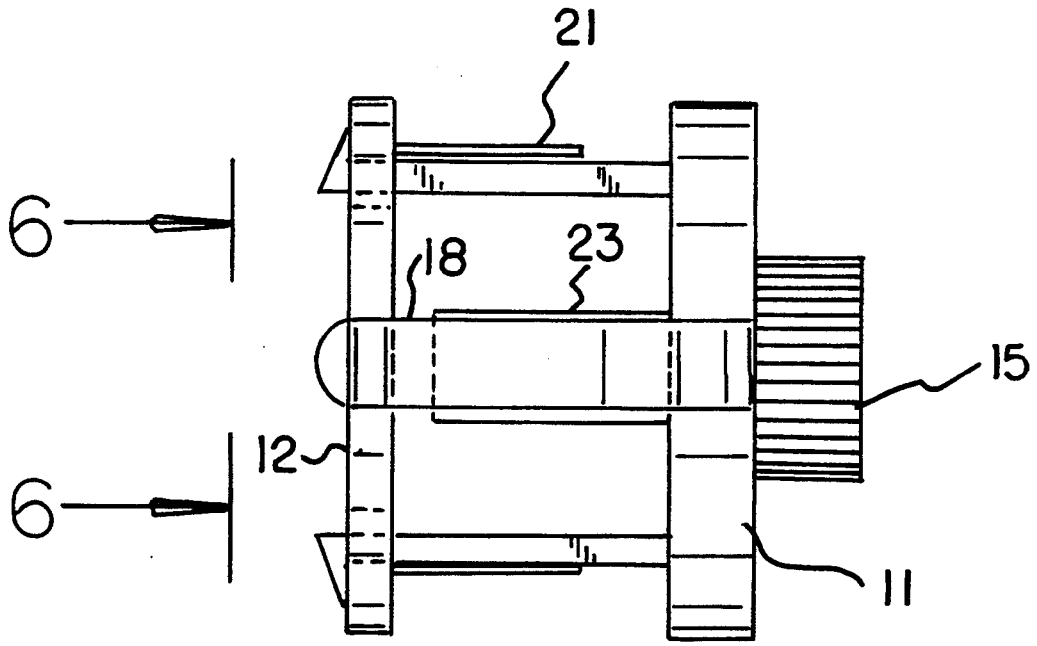
FIG. 5 is a bottom plan view of the device of the present invention in its locked configuration.

With reference now to the drawings, and in particular to FIGS. 1 and 2 thereof, a new and improved firearm trigger locking device embodying the principles and concepts of the present invention and generally designated by the reference numeral 10 will be described.

More specifically, it will be noted that the firearm locking device 10 basically comprises two discs 11 and 12. Disc 11 is shown in FIG. 1 in place on the firearm (illustrated in broken lines). The exterior face 13 of disc 11 carries thereon a series of numbered indicia 14 which provide the indicators for an unlocking combination (as more clearly described below). Such indicia 14 are preferably luminescent so that they can be seen in the dark. Knob 15 has an indicator projection 16 from the surface thereof. The second or companion disc 12 of lock 10 is shown in FIG. 2. Projecting inwardly from the center of the interior face 17 is a locking pin 18. Likewise projecting inwardly from such interior face 17 is a pair of springily bendable guide rods 19. These are positioned adjacent a set of apertures 20 in such face 17. At the bottom of disc 11 is affixed a flexible connecting band 21 which extends loosely to an anchorage at the base of disc 11.

FIGS. 3 and 4 show the locking device 10 in its open position. In these drawings, the components of device 10 are more readily apparent. From the interior face 17 the projecting locking pin 18 is shown. Pin 18 has a pair of locking grooves 22 therein which will cooperate with tumblers in the mating receptacle 23 extending inwardly from the interior face 24 of disc 11. The springily bendable guide rods 19 also are shown extending from face 17. Rods 19 are adapted to guide a pair of tapered spring detent arms 25 (best shown in FIG. 4) extending from face 24 of disc 11 into apertures 20 in disc 12. Arms 25 have an enlarged head 26 which prevents accidental dislodgement from apertures 20 when arms 25 project therethrough. Knob 15 is shown extending from the outer face of disc 11. Flexible band 21 connects the two discs 11 and 12 loosely together to prevent loss of a disc when not in place on a firearm.

Figure 6:
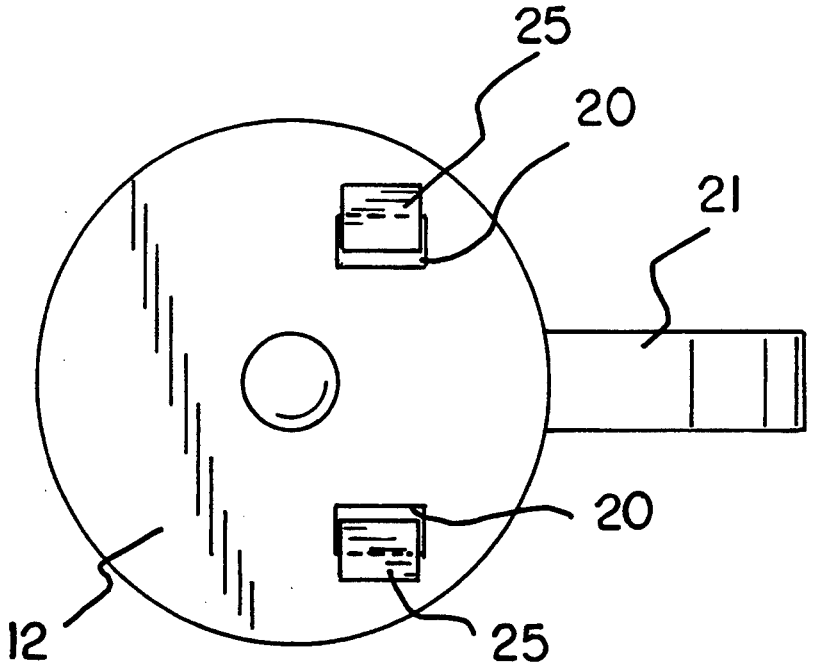
FIG. 6 is an end view on line 6—6 of FIG. 5.

FIGS. 5 and 6 show the locking device 10 in closed position. Discs 11 and 12 are now locked together by the detent arms 25 and the enlarged ends 26 thereon extending through apertures 20. Locking pin 18 is engaged within its receptacle 23 and will be released only upon rotation of knob 15 to the two preset numbers 14 on the exterior face of disc 11.

Figure 7:
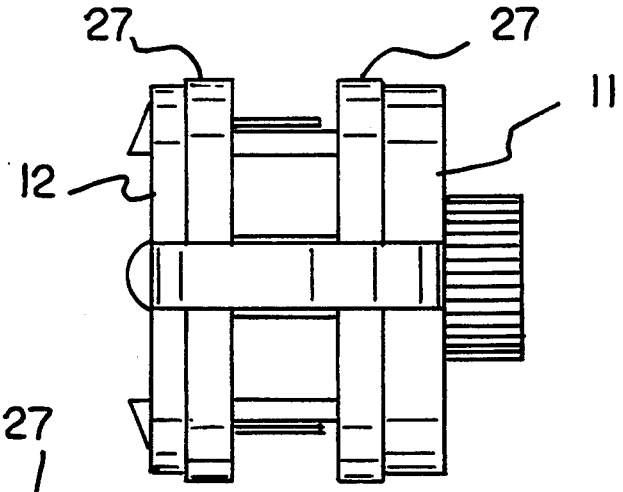
FIGS. 7 and 8 show the device of the present invention with the addition of cushioning pads to protect the finish of the firearms to which it is applied.
Figure 8:
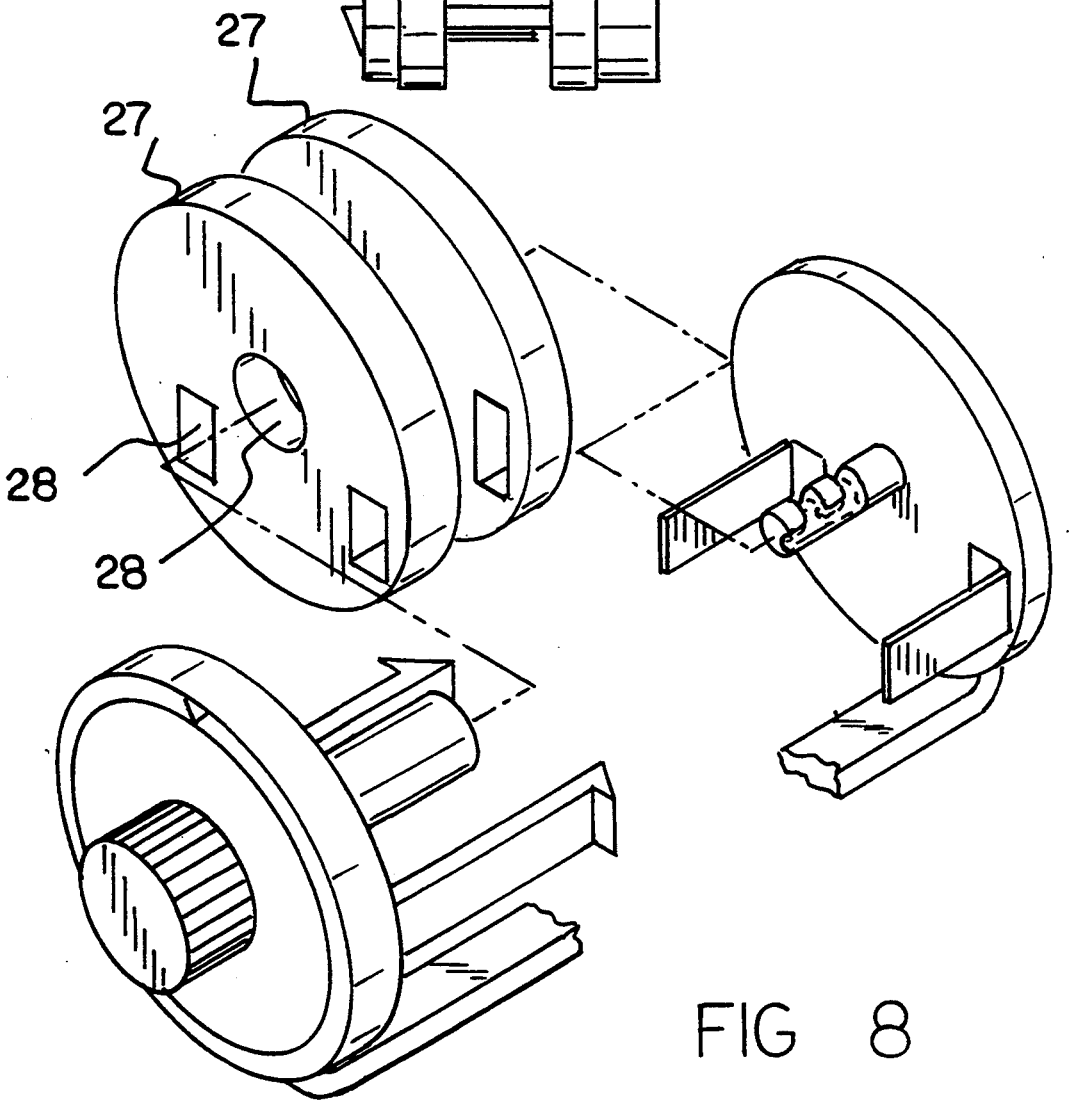

In some instances, particularly with expensive or show type firearms, the faces of discs 11 and 12 which usually are formed of thin metal, e.g. aluminum or steel, or hard plastic may present danger of scratching of the firearm to which they are applied. In such instances as shown in FIGS. 7 and 8, a pair of resilient pads 27, may be interposed between discs 11 and 12. Such pads 27 are perforated as at 28 to permit the locking members 18. 23, and 25 to extend therethrough.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A firearm trigger lock which comprises a pair of circular discs adapted to engage either side of a firearm trigger guard; a plurality of locking members adapted to extend between and engage with said circular discs, said locking members extending through the trigger guard of a firearm to be protected and preventing movement of the trigger of such firearm when in place; one of said locking members extending centrally from one of said circular discs to the other and being secured in place by a combination lock means carried by one of said circular discs, wherein said plurality of locking members include a pair of tapered spring detent arms extending from one of said circular discs and engaging in and spring locking to the other of said circular discs.

2. A firearm trigger lock comprising a pair of circular discs adapted to engage either side of a firearm trigger guard; a plurality of locking members adapted to extend between and engage with said circular discs, said locking members extending through the trigger guard of a firearm to be protected and preventing movement of the trigger of such firearm when in place; one of said locking members extending centrally from one of said circular discs to the other and being secured in place by a combination lock means carried by one of said circular discs, wherein said circular discs are loosely connected one to the other by a flexible band extending therebetween.

* * * * *